US008536795B2

(12) United States Patent
Namba et al.

(10) Patent No.: US 8,536,795 B2
(45) Date of Patent: Sep. 17, 2013

(54) APPARATUS FOR DRIVING FIELD EMISSION LAMP

(75) Inventors: Atsushi Namba, Tokyo (JP); Seiichi Anzawa, Nagano (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 219 days.

(21) Appl. No.: 13/041,971

(22) Filed: Mar. 7, 2011

(65) Prior Publication Data

US 2011/0221359 A1 Sep. 15, 2011

(30) Foreign Application Priority Data

Mar. 10, 2010 (JP) ..... 2010-052878

(51) Int. Cl.
*H05B 37/02* (2006.01)

(52) U.S. Cl.
USPC ..... 315/291; 315/209 R; 315/294

(58) Field of Classification Search
USPC ..... 315/209 R, 246, 250, 291, 294, 297, 315/307, 312
See application file for complete search history.

(56) References Cited

U.S. PATENT DOCUMENTS

| | | | | |
|---|---|---|---|---|
| 3,707,648 | A * | 12/1972 | Rosa | 315/231 |
| 5,869,937 | A * | 2/1999 | Konopka | 315/291 |
| 7,288,903 | B2 * | 10/2007 | Jang et al. | 315/307 |
| 7,586,272 | B2 * | 9/2009 | Iida et al. | 315/291 |
| 7,742,031 | B2 * | 6/2010 | Numao | 345/102 |
| 8,358,082 | B2 * | 1/2013 | Henry et al. | 315/247 |
| 2005/0269970 | A1 * | 12/2005 | Jang et al. | 315/291 |
| 2009/0026971 | A1 * | 1/2009 | Yun | 315/174 |
| 2009/0243491 | A1 * | 10/2009 | Iwai | 315/116 |

FOREIGN PATENT DOCUMENTS

JP 2009-238414 10/2009

* cited by examiner

*Primary Examiner* — Tung X Le
(74) *Attorney, Agent, or Firm* — Konomi Takeshita

(57) ABSTRACT

This control device, for a representative lamp L1, by way of a power control circuit 20, detects the cathode current Ik from a resistor TRk1, and controls a high-voltage stabilizing circuit 10, and performs drive control so that the gate voltages, which were divided from the output voltage Vgo from the high-voltage stabilizing circuit 10, become suitable voltages. Moreover, the control device, for other lamps L2, . . . , Ln, by way of the power control circuit 20, changes the voltage dividing ratio of impedance dividing by resistors R2_1, R2_2, . . . , Rn_1, Rn_2 for the output voltage Vgo using control elements Q2, . . . , Qn, and performs control so that the cathode current of each of the lamps L2, . . . , Ln becomes the same as the cathode current of the representative lamp L1.

4 Claims, 6 Drawing Sheets

APPARATUS FOR DRIVING FIELD EMISSION LAMP

CROSS REFERENCE TO RELATED APPLICATION

This application claims priority under 35 U.S.C. 119 based upon Japanese Patent Application Serial No. 2010-052878, filed on Mar. 10, 2010. The entire disclosure of the aforesaid application is incorporated herein by reference.

FIELD OF THE INVENTION

The present invention relates to an apparatus for driving field emission lamp that excites and causes a fluorescent substance to emit light by field emitted electrons that are emitted from an electron emission source.

BACKGROUND OF THE INVENTION

In recent years, field emission lamps have been developed for conventional incandescent light bulbs and fluorescent lights. This type of lamp, in a vacuum vessel, causes field emission of electrons to occur by applying a positive voltage to a cathode that has an electron emission source, and causes fluorescent luminescence by causing these field emitted electrons to collide with a fluorescent substance on an anode. By properly controlling the voltage of a gate electrode that is provided between the cathode and anode, high luminance emitted light can be obtained with low power consumption.

In order to drive this kind of field emission lamp, high direct-current voltage from a switching power source is necessary; for example, JP Patent Application Publication No. 2008-13917 discloses a method in which a resonance circuit, which uses the stray capacitance of a step-up transformer for raising the switched input voltage, is used to match the ON/OFF timing of the switching signal with the resonance conditions of the resonance circuit. In doing so, it is possible to improve the high-voltage conversion efficiency by eliminating loss due to the components of a power-supply circuit, and it is possible to make the device more compact and reduce cost due to simplifying the overall circuit configuration.

However, in a field emission lamp, it is impossible to avoid variation in lamp characteristics that are caused by variation in characteristics of the electron emission source and fluorescent substance, variation in the distance between electrodes due to manufacturing, and change over time. Therefore, even when attempting to drive a plurality of lamps with the same power, there is a problem in that the optimal driving conditions for each individual lamp are different.

Therefore, when using a plurality of field emission lamps for lighting and trying to obtain uniform emitted light from each lamp using the same power, conventionally it was necessary to prepare drive units for each individual lamp respectively. Consequently, this causes an increase in the overall size and cost of the driving apparatus due to the increase in circuit parts.

SUMMARY OF THE INVENTION

Considering the above situation, the purpose of the present invention is to provide an apparatus for driving field emission lamp that is capable of driving a plurality of field emission lamps with constant power and only one drive apparatus, and that is capable of avoiding a increase in size and cost of the drive apparatus due to an increase in circuit parts.

According to a first embodiment of the present invention for solving the problems described above, there is provided an apparatus for driving a plurality of field emission lamps including at least one representative lamp and at least one other lamp the apparatus comprising:

a power-supply unit, configured to connect to an electric power source, for generating stable direct-current power by utilizing electric power supplied from the electric power source, a first control unit, being connected to the power-supply unit and a gate electrode of the representative lamp, for applying to a gate electrode of the representative lamp a representative gate voltage having a potential corresponding to an output voltage of the power-supply unit, the first control unit controlling the output voltage of the power-supply unit such that the representative gate voltage becomes suitable to the representative lamp; and a second control unit, being connected to the power-supply unit and a gate electrode of the other lamp, for applying to a gate electrode of the other lamp a gate voltage which is generated by dividing the output voltage of the power-supply unit, the second control unit controlling a dividing ratio of the output voltage such that electrical power used for driving the other lamp becomes the same as electrical power used for driving the representative lamp.

According to a second embodiment of the present invention for solving the problems described above, there is provided an apparatus for driving a plurality of field emission lamps, the apparatus comprising:

a power-supply unit, configured to connect to an electric power source, for generating stable direct-current power by utilizing electric power supplied from the electric power source, a third control unit, being connected to the power-supply unit, for controlling an output voltage of the power-supply unit; and a fourth control unit, being connected to the power-supply unit and a gate electrode of each of the field emission lamps, the forth control unit generating a gate voltage for each of the field emission lamps by dividing the output voltage of the power-supply unit for each of the field emission lamps, and applying the generated gate voltage to the gate electrode of each of the field emission lamps, the fourth control unit controlling a dividing ratio of the output voltage for each of the gate voltages so that electrical power used for driving each of the field emission lamps become even, wherein the third control unit controls the output voltage of the power-supply unit so that each gate voltage is suitable to the respective field emission lamp.

With the present invention, it is possible to drive a plurality of field emission lamps at constant power with one drive apparatus. Therefore, it is possible to avoid an increase in size and cost due to an increase in the number of circuit parts.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
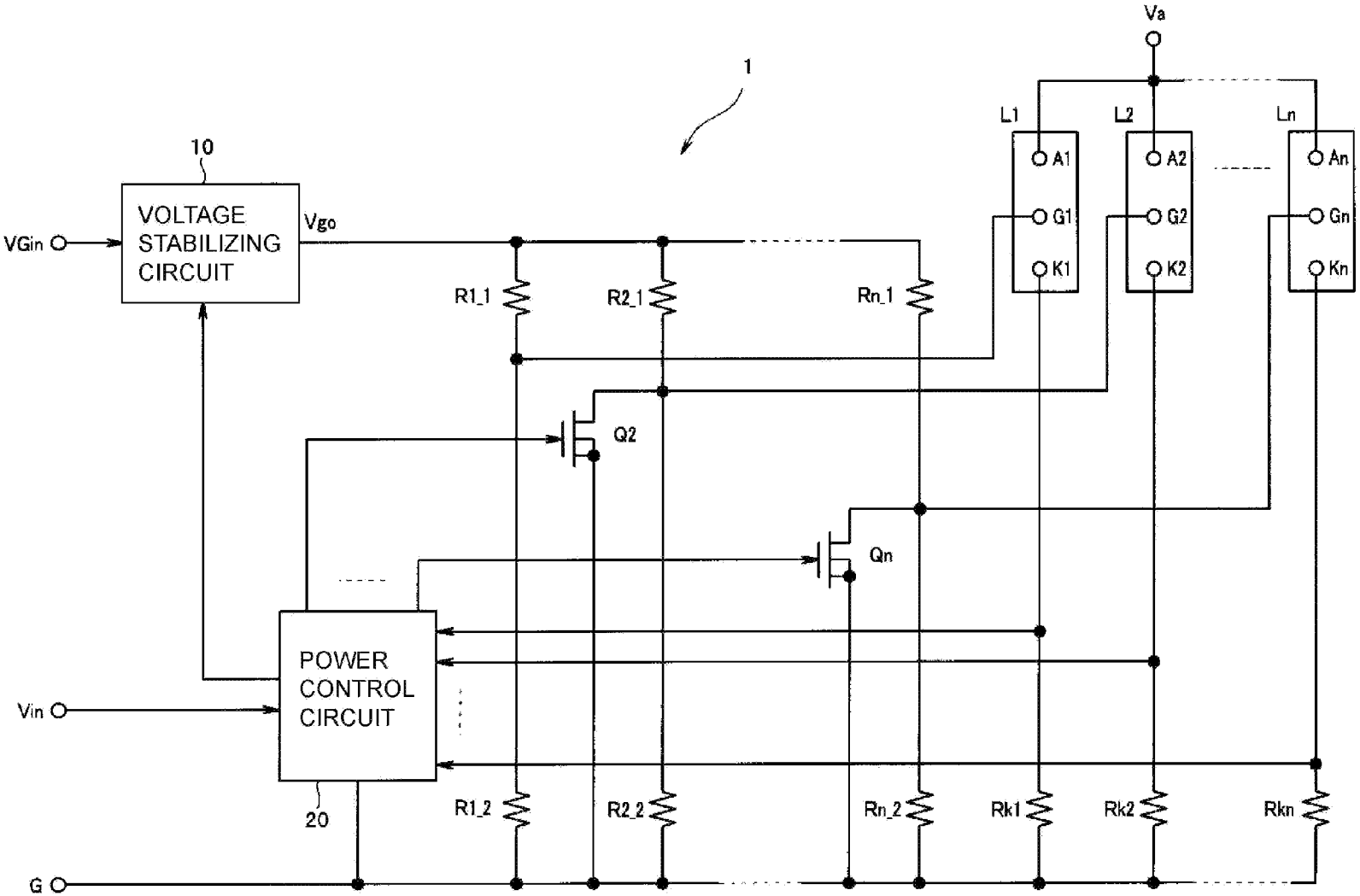
FIG. 1 is a circuit block diagram of the lamp drive apparatus of a first embodiment of the present invention.

In the following, preferred embodiments of the present invention will be described in detail with reference to the accompanying, exemplary diagrams. First, a first embodiment of the present invention will be explained. As illustrated in FIG. 1, with the object of driving a plurality of n number (n is 2 or greater) field emission lamps L1, L2, . . . , Ln, the lamp drive apparatus 1 of this first embodiment generates high direct-current voltage from input voltage VGin in order to generate gate voltage that is applied to each field emission lamp. Moreover, this drive apparatus 1 has a high-voltage stabilizing circuit 10 that supplies stable voltage, and a power control circuit 20 that controls the gate voltage of a plurality of field emission lamps L1, L2, . . . , Ln, and drives each field emission lamp at constant power.

The field emission lamps (hereafter, referred to simply as "lamps") L1, L2, . . . , Ln are known cold cathode field emission light emitting devices that excite and cause a fluorescent substance to emit light by causing electrons that are field emitted in a vacuum from an electron emission source to collide at high speed with the fluorescent substance. The object of the lamp drive apparatus 1 is to drive lamps having 3-pole structure. A lamp having three-pole structure has a cathode having an electron emission source and an anode having a fluorescent substance that are separated by a specified interval inside a vacuum, and a gate electrode that is located between the cathode and the anode.

The plurality of lamps L1, L2, . . . , Ln are selected such that the variation in lamp characteristics, which is caused by variation in characteristics of the electron emission source and fluorescent substance, variation in the distance between electrodes due to manufacturing and changes over time, is within a fixed range. Taking an arbitrary lamp from among this plurality of lamps L1, L2, . . . , Ln to be a representative lamp, the lamp drive apparatus 1 drives the gate voltage according to the characteristics of this representative lamp. The drive apparatus 1 also controls the gate voltage of the other lamps according to the variation in characteristics of this representative lamp as a reference.

In the following, the case in which one lamp from among the plurality of lamps L1, L2, . . . , Ln is selected as a representative lamp is explained, with that representative lamp being lamp L1. Here, the relationship between the lamp current (cathode current) and gate voltage of lamp L1 at a certain constant anode voltage Va is represented by a curve as illustrated by the bold line in FIG. 2. On the other hand, lamps L2, . . . , Ln, due to variation in characteristics, have variation such that the relationship between the lamp current and gate voltage at the same anode voltage is within a range that includes the dashed line in FIG. 2. Therefore, when driving the lamps L2, . . . Ln by the same gate voltage as representative lamp L1, there is fluctuation in lamp power.

Therefore, the drive apparatus 1 drives the representative lamp L1 at a gate voltage Vg that is constant power, and when the lamp current is a constant current value Ik, controls the gate voltage of the other lamps L2, . . . , Ln within a variation width ΔVg. By doing so, the drive apparatus 1 can drive the lamps L2, . . . , Ln at the same lamp current Ik as the representative lamp. As a result, it becomes possible to drive all of the lamps L1, L2, . . . , Ln at constant power even when there is variation in lamp characteristics, and fluctuation in anode voltage.

Figure 2:
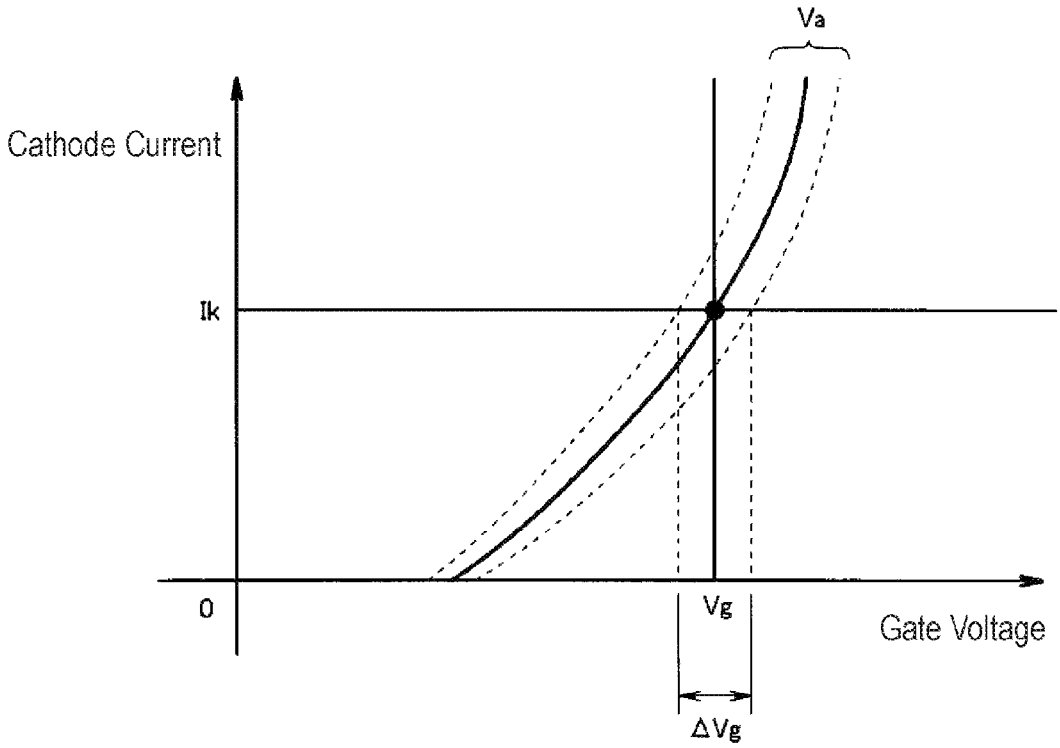
FIG. 2 is a diagram illustrating the relationship between gate voltage and lamp current in a first embodiment of the present invention.

In FIG. 2, for convenience, the characteristics of the representative lamp L1 is illustrated near the center of the variation width of the lamps L2, . . . , Ln. However, lamp characteristics of the representative lamp do not need to be in the center of the characteristics of all of the lamps. In other words, an arbitrary lamp can be selected from among a plurality of lamps, whose variation widths are within a specified range, as a representative lamp. This is because the lamp drive apparatus 1 of this embodiment does not control the lamps other than the representative lamp according to the difference with the center of the characteristic variation width, but performs control according to the difference with the characteristics of the representative lamp.

More specifically, the gate electrodes G1, G2, . . . Gn of the lamps L1, L2, . . . , Ln are connected to the output end of the high-voltage stabilizing circuit 10 via resistors R1_1, R2_1, . . . , Rn_1, and are grounded via resistors R1_2, R2_2, . . . , Rn_2. Moreover, control elements Q2, . . . , Qn, comprising field effect transistors (FET), are connected in parallel with the resistors R2_2, . . . , Rn_2 to the gate electrodes G2, . . . , Gn of the lamps L2, . . . , Ln other than the representative lamp L1.

Furthermore, the cathodes K1, K2, . . . , Kn of the lamps L1, L2, . . . , Ln are connected via resistors Rk1, Rk2, . . . , Rkn for detecting the cathode current. The cathode side of the resistors Rk1, Rk2, . . . , Rkn are connected to the input side of the voltage control circuit 20. Anode voltage Va that is higher than the gate voltage is applied to the anodes A1, A2, . . . , An of the lamps L1, L2, . . . , Ln.

With the voltage between both ends of the resistor Rk1 as input, the voltage control circuit 20 generates a control signal for controlling the high-voltage stabilizing circuit 10. Moreover, with the voltage between both ends of the resistors Rk2, . . . , Rkn as input, the power control circuit 20 generates a control signal for performing drive control of the control elements Q2, . . . , Qn. In other words, by functioning as a first control unit, the power control circuit 20 detects the cathode current Ik by the resistor Rk1 that is connected to the cathode K1 of the representative lamp L1, and controls the high-voltage stabilizing circuit 10. Moreover, the gate voltage, which is obtained by dividing the output voltage Vgo from high-voltage stabilizing circuit 10 by the resistors R1_1 and R1_2 is controlled so that it becomes a suitable voltage and the cathode current Ik of the representative lamp L1 is constant.

By functioning as a second control unit, in connection with the output voltage Vgo from the high-voltage stabilizing circuit 10, the power control circuit 20 changes the dividing ratios of the dividing impedance by the resistors R2_1, R2_2, . . . , Rn_1, Rn_2 by controlling the conduction of the control elements Q2, . . . , Qn, and controls the gate voltages of the lamps L2, . . . , Ln. In other words, the gate voltages of the lamps L2, . . . Ln are voltages obtained by dividing the voltage Vgo with a dividing ratio based on resistors R2_1, . . . , Rn_1, resistors R2_2, . . . , Rn_2 and the ON resistance of control elements Q2, . . . , Qn. The cathode current of each lamp L2, . . . , Ln, is controlled individually so that it becomes the same as the cathode current Ik of the representative lamp L1. As a result, it is possible to drive the lamps L1, L2, . . . , Ln with constant power even when there is variation in characteristics due to individual differences in the lamps L1, L2, . . . , Ln, and changes over time, and when there is fluctuation in the anode voltage.

Figure 3:
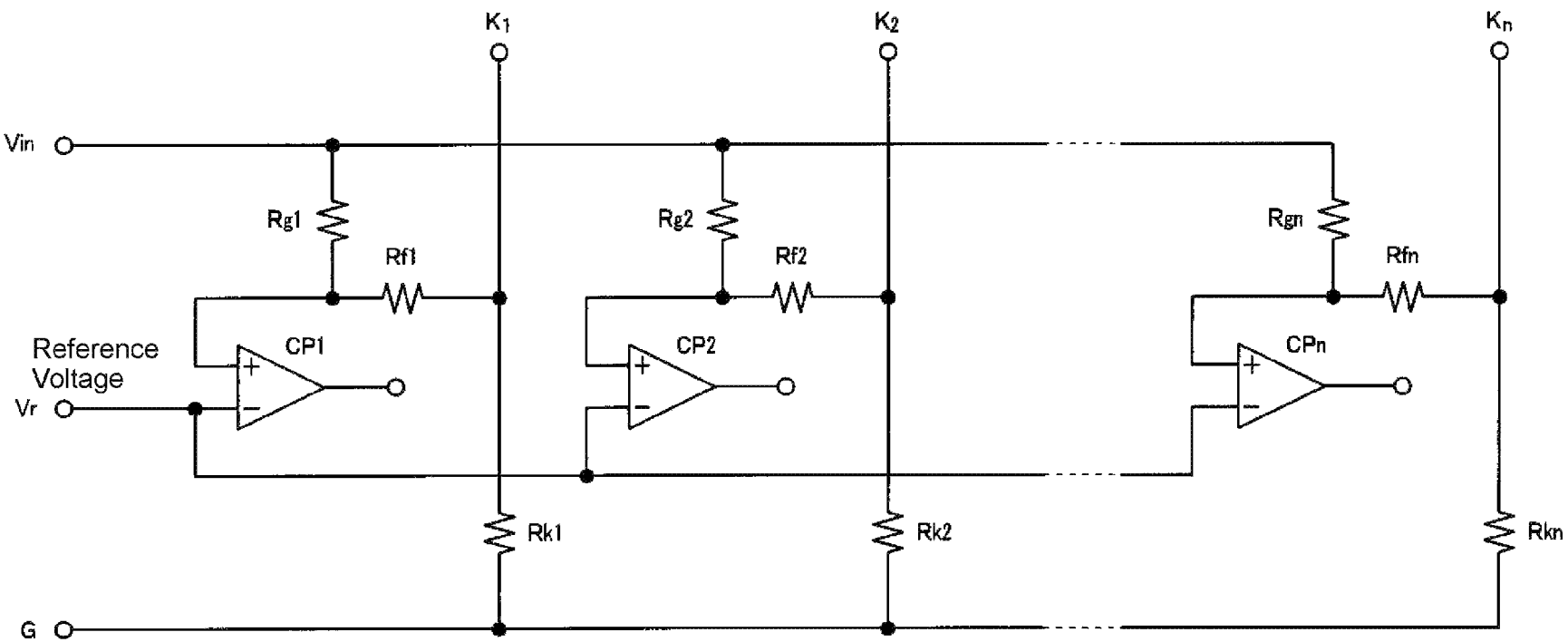
FIG. 3. is a diagram illustrating the basic construction of a power control circuit of a first embodiment of the present invention.

As illustrated in FIG. 3, this kind of power control circuit 20 is constructed using the comparators CP1, CP2, . . . , CPn that are provided for each lamp. The comparators CP1, CP2, . . . , CPn output control signals to the high-voltage stabilizing circuit 10 and to the control elements Q2, . . . , Qn, which are connected to the gate side of each lamp, based on comparison voltage Vin that is inputted from the outside, and detected voltages from the resistors Rk1, Rk2, . . . , Rkn for detecting the cathode current of each lamp.

The voltage Vin that is inputted from the outside to each comparator CP1, CP2, . . . , CPn is voltage based on the lamp anode voltage Va, and is a voltage that is proportional to the anode voltage Va. This kind of voltage that is proportional to the anode voltage can be generated, for example, by using a transformer in the power-supply circuit that generates the anode voltage, or by using a voltage doubler rectifier circuit.

More specifically, the resistors Rk1, Rk2, . . . , Rkn for detecting the cathode current in each lamp are connected to non-inverting input terminals (+terminals) of the comparators CP1, CP2, . . . , CPn via resistors Rf1, Rf2, . . . , Rfn, together with resistors Rg1, Rg2, . . . , Rgn for inputting voltage Vin from the outside for comparison. The comparators CP1, CP2, . . . , CPn compare a specified reference voltage Vr that is applied to the inverting input terminals (−terminals) with the voltage applied to the non-inverting input terminals (+terminals), or in other words, compare the voltage Vin that is proportional to the anode voltage Va, with voltage that is based on the voltage for detecting anode current. The comparators output a control signal to the high-voltage stabilizing circuit 10, and output a control signal to the control elements Q2, . . . , Qn that are connected to the gate side of each lamp.

Figure 4:
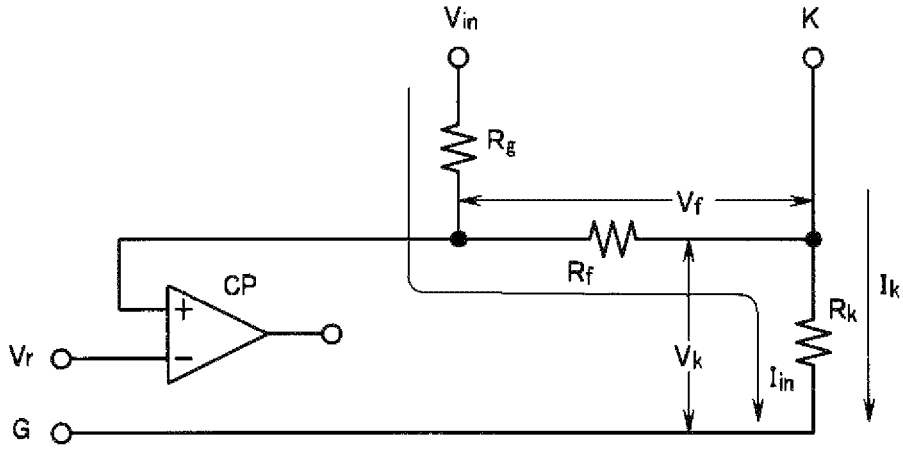
FIG. 4 is a diagram illustrating the voltage and current of each part in a power control circuit of a first embodiment of the present invention.

Using the comparator CP of one lamp as a representative comparator, the operation of the power control circuit 20 will be explained below while referencing FIG. 4. In FIG. 4, Ik is the cathode current that flows in the current-detection resistor Rk that is connected to the cathode K, Iin is the current that flows in the current-detection resistor Rk via resistor Rg and resistor Rf due to the input voltage Vin, Vf is the voltage at both ends of the resistor Rf, and Vk is the voltage at both ends of the resistor Rk, so with the premise that the input voltage Vi is proportional to the anode voltage Va, the input voltage Vin and resistors Rg, Rf and Rk are set so that the conditions of equations (1) to (3) below are satisfied.

$$Vin >> Vk + Vf \tag{1}$$

$$Va >> Vk \tag{2}$$

$$Ik >> Iin \tag{3}$$

Here, the voltage Vf on both ends of the resistor Rf is nearly proportional to the anode voltage Va, and the voltage Vk on both ends of the resistor Rk is nearly proportional to the cathode current Ik. Moreover, the lamp power P is P=Va×Ik, so can be represented by a value that is nearly proportional to Vk×Vf. Therefore, as illustrated in equation (4) below, the power P' that is expressed as Vk×Vf can be used as a control parameter for the actual lamp power P.

$$P' = Vk \times Vf = (Vr - Vf) \times Vf = Vr \times Vf - Vf2 \tag{4}$$

Figure 5:
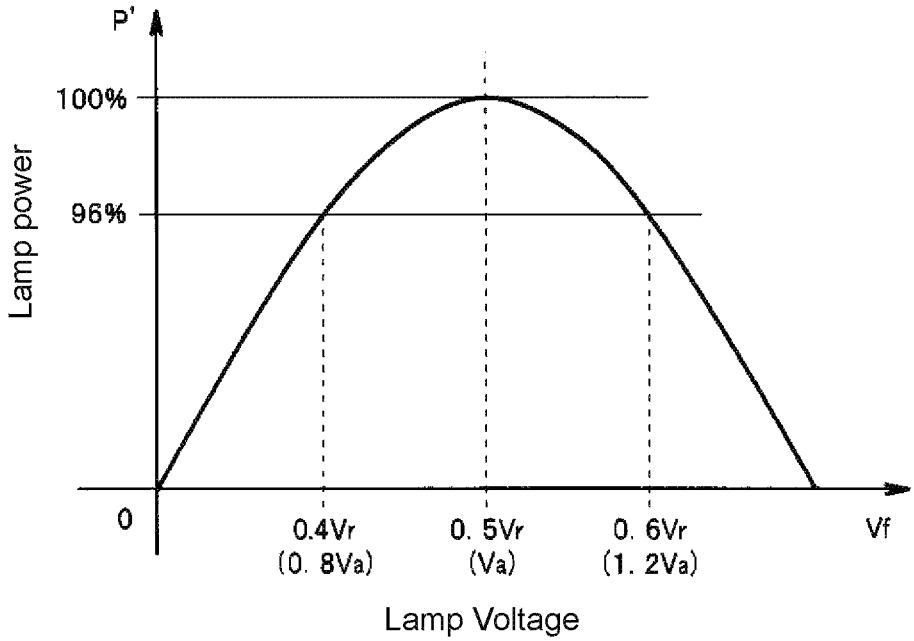
FIG. 5 is a diagram illustrating the relationship between the lamp power and lamp voltage in a first embodiment of the present invention.

FIG. 5 is a graph illustrating the relationship between the power P' and voltage Vf in equation (4). Presuming that the lamp power is 100% when Vf=Vk, then when Vf=0.5×Vr, Vk=0.5×Vr and the power P' becomes 100%, and the curve resembles the actual change in lamp power P. Therefore, by controlling the gate voltage of each lamp by way of the output voltage Vgo of the high-voltage stabilizing circuit 10 or the control elements Q so that the voltage (Vk+Vf), which is the non-inverted input of the comparator CP, becomes equal to the constant reference voltage Vr, which is the inverted input, it is possible to drive each of the lamps with a constant power that is the same as that of the representative lamp.

The high-voltage stabilizing circuit 10, for example, by controlling the voltage dividing ratio for dividing the voltage, which has been lowered from the input voltage VGin and stabilized, based on the output of the comparator of the power control circuit 20, generates a voltage for applying proper gate voltage to the representative lamp, and outputs that voltage as Vgo.

In this way, in this embodiment, the gate voltage of a representative lamp that represents a plurality of lamps is controlled, and the gate voltages of the other lamps are corrected according to the variation in lamp characteristics. As a result, it is possible to drive all of the lamps at constant power. Therefore, there is no need as in the conventional case, to have a high-voltage stabilizing circuit and power control circuit for each individual lamp in order to properly maintain the gate voltages, and thus it is possible to reduce costs by decreasing the number of parts.

In the invention described above, an example of selecting one arbitrary lamp from among a plurality of lamps whose lamp characteristics are within a fixed range as a representative lamp was explained. However, it is also possible to select a plurality of lamps having similar characteristics as representative lamps. For example, even among lamp characteristics within a fixed range, by collecting a plurality of lamps that have similar lamp characteristics, it is possible divide all of the lamps into a plurality of lamp groups. In that case, one arbitrary lamp group is selected from among the plurality of lamp groups as a representative.

In this case as well, the lamp drive apparatus 1 operates in the same way as explained above. In other words, the power control circuit 20 controls the output Vgo from the high-voltage stabilizing circuit 10 so that it becomes a voltage that applies a suitable gate voltage of the representative lamp group to the plurality of representative lamps (representative lamp group). Moreover, the gate voltages of other lamp groups are controlled so that they have the same power as the representative lamp group.

Next, a second embodiment of the present invention is explained. In the first embodiment, an arbitrary representative lamp is set from among a plurality of lamps that are to be driven, and the other lamps are controlled so as to match the characteristics of that representative lamp. However, in this second embodiment, a representative lamp is not set, but rather representative characteristics of all of the plurality of lamps are investigated beforehand. Then the high-voltage stabilizing circuit 10 generates a voltage that conforms to the representative characteristics. Based on the output from the high-voltage stabilizing circuit 10, the gate voltage of each lamp is controlled by a circuit having the same construction.

Figure 6:
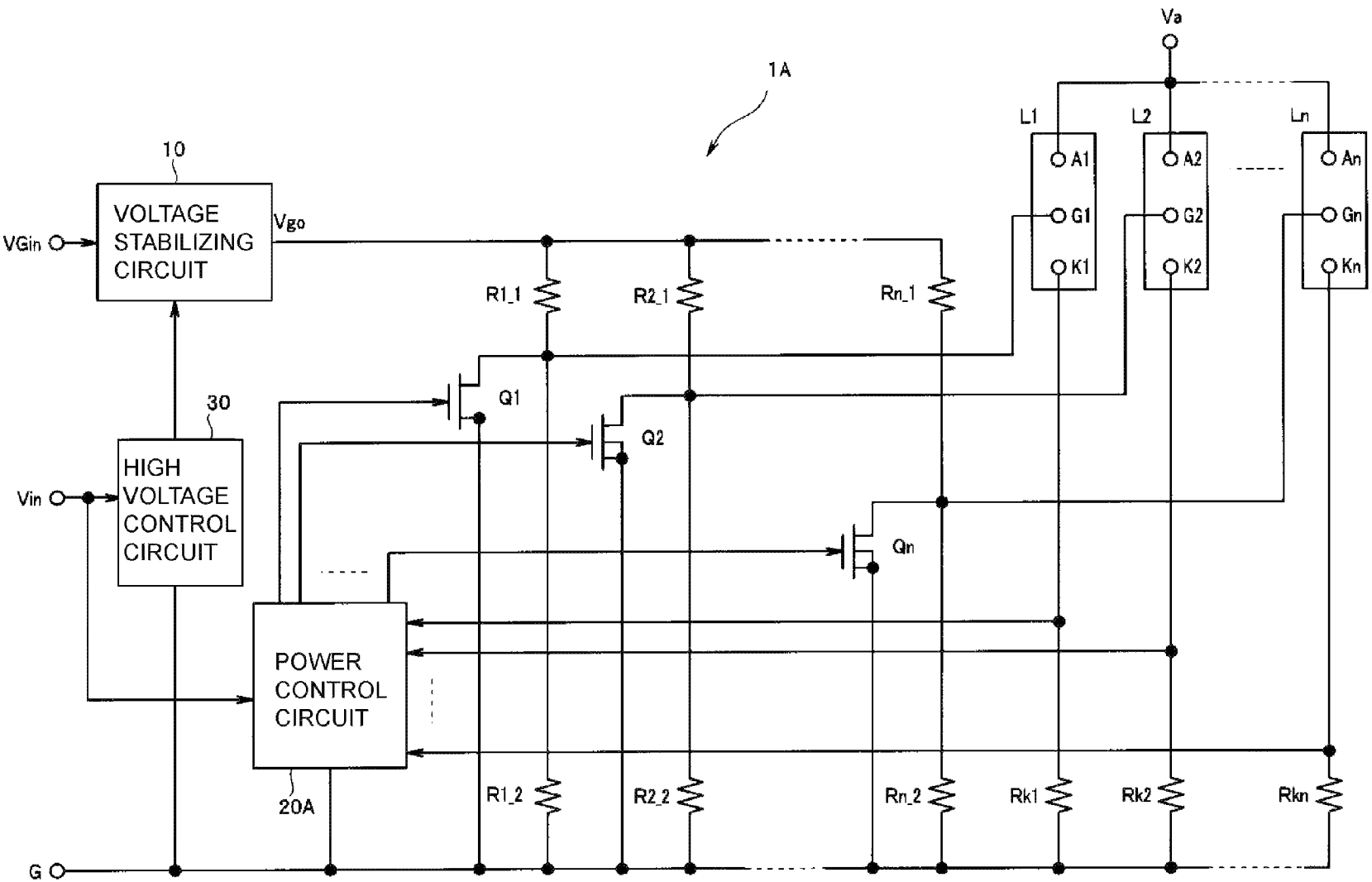
FIG. 6 is a circuit block diagram of the lamp drive apparatus of a second embodiment of the present invention.

Therefore, as illustrated in FIG. 6, in the lamp drive apparatus 1A of this second embodiment, differing from the first embodiment, control of the high-voltage stabilizing circuit 10 is performed by a high-voltage control circuit 30 instead of the power control circuit 20. Moreover, together with this, the function of the power control circuit 20 is changed a little such that the power control circuit 20A controls the gate voltages of the plurality of lamps L1, L2, . . . , Ln. Therefore, a control element Q1 for controlling the gate voltage is added for lamp L1. The other construction is the same as in the first embodiment, so in the following, mainly the high-voltage control circuit 30 will be explained.

Figure 7:
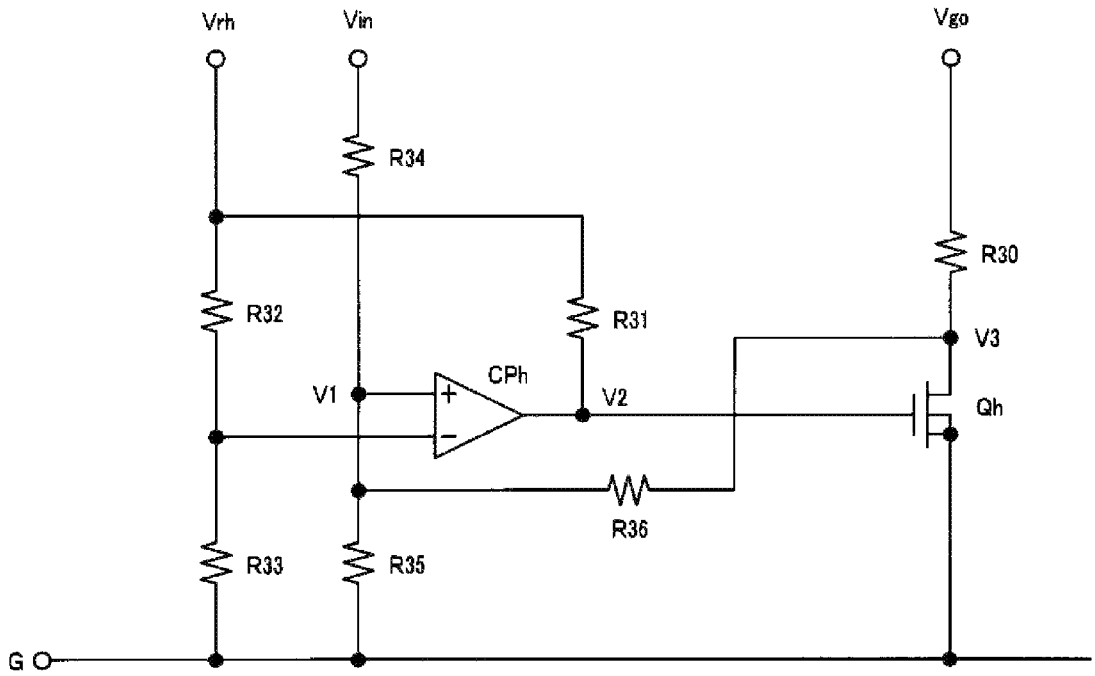
FIG. 7 is a diagram illustrating the construction of a high-voltage control circuit of a second embodiment of the present invention.

As illustrated in FIG. 7, the high-voltage control circuit 30 mainly comprises a comparator CPh and a control element Qh having a FET and the like. More specifically, the control element Qh, which controls the output voltage Vgo from the high-voltage stabilizing circuit 10 via a resistor R30, is connected to the output terminal side of the comparator CPh.

The output side of the comparator CPh is connected to the inverting input terminal (−terminal) via the resistors R31 and R32, and is grounded via the resistor R33. The reference voltage Vrh that is divided by the resistors R32 and R33 is applied to the inverting input terminal (–terminal) of the comparator CPh. On the other hand, the resistors R34 and R35 for dividing the input voltage Vi that is proportional to the lamp anode voltage Va are connected to the non-inverting input terminal (+terminal) of the comparator CPh, and further the voltage on the anode side of the control element Qh is applied via the resistor R36.

The high-voltage control circuit 30 having this kind of construction functions as a third control unit that controls the stabilizing voltage for generating gate voltages suitable for all of the plurality of lamps L1, L2, . . . , Ln. In other words, the high-voltage control circuit 30 performs a control operation so that the output voltage Vgo from the high-voltage stabilizing circuit 10 becomes a voltage that applies gate voltages that are suitable to the representative characteristic of the lamps L1, L2, . . . , Ln. In this control operation, taking the voltage that is applied to the non-inverting input terminal of the comparator CPh to be V1, the voltage on the output side of the comparator CPh to be Vin and the voltage on the anode side of the control element Qh to be V3, the relationship between the input voltage Vin of the high-voltage control circuit 30 (voltage proportional to the anode voltage Va) and the voltages V1, V2 and V3 become a relationship as illustrated in FIG. 8.

Figure 8:
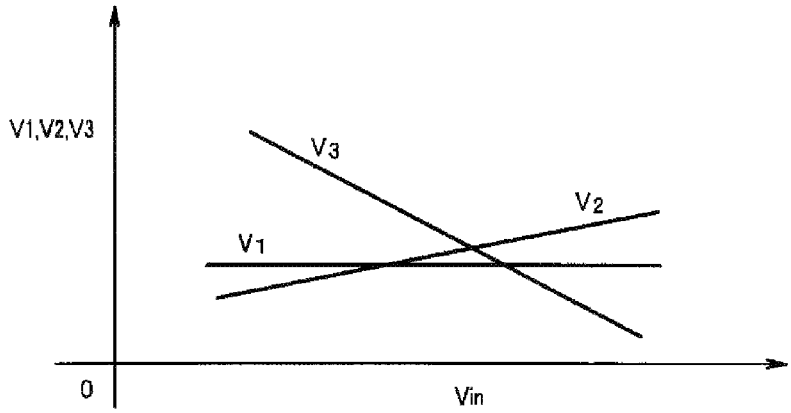
FIG. 8 is a diagram illustrating the relationship between the input voltage to the high-voltage control circuit and voltage of each part of a second embodiment of the present invention.

As is clear from FIG. 8, as the input voltage Vin to the high-voltage control circuit 30 rises, the voltage V1 on the non-inverting input side of the comparator side rises proportional to the input voltage Vin, and the output voltage V2 of the comparator rises even more than the rise of the voltage V1. At this time, due to the output from the comparator CPh, the control element Qh conducts and the voltage V3 drops, so the voltage Vgo from the high-voltage stabilizing circuit 10 also drops Therefore, by setting the resistance values of all of the resistors so that the voltage Vgo is suitable to the change in input voltage Vin, the gate voltages having the representative characteristic are controlled based on voltage V3 according to the change in lamp voltage (anode voltage) Va. However, in this case, the change in voltage V3 is linear with respect to the change in input voltage Vin that is proportional to the lamp anode voltage Va. As a result, error occurs due to the relationship between the anode voltage and the suitable gate voltage not being linear.

This error can be corrected by the power control circuit 20A performing constant power control of each lamp, including the variation in individual lamp characteristics. When doing this, the power control circuit 20A drives each of the plurality of lamps L1, L2, . . . , Ln by gate voltages obtained by dividing the output voltage Vgo from the high-voltage stabilizing circuit 10. Moreover, the power control circuit 20A functions as a fourth control unit that controls the dividing ratio of the voltage Vgo and performs drive control so that all of the lamps are driven by the same power. Except for controlling the representative lamp, the main function of this embodiment is the same as that of the first embodiment.

In this way, in this second embodiment, there is no representative lamp from among a plurality of lamps as in the first embodiment, so even though a problem may occur in the representative lamp, there is not effect on the control of the other lamps. Moreover, all of the lamps are droved by circuits having the same construction, so there are no differences in the lamp driving characteristics de to differences among circuits.

In this second embodiment as well, as in the first embodiment, it is possible to collect a plurality of lamps having similar lamp characteristics as each other from a plurality of lamps having lamp characteristics within a fixed range, and divide all of the lamps into a plurality of lamp groups. In that case, control can be performed for lamp groups or control can be performed for individual lamps so that the gate voltages of the lamps become gate voltages that are suitable to the overall representative characteristics.

It is to be understood that the above-described embodiments are illustrative of only a few of the many possible specific embodiments which can represent applications of the principles of the invention. Numerous and varied other arrangements can be readily devised by those skilled in the art without departing from the spirit and scope of the invention.

What is claimed is:

1. An apparatus for driving a plurality of field emission lamps including at least one representative lamp and at least one other lamp, the apparatus comprising:

a power-supply unit, configured to connect to an electric power source, for generating stable direct-current power by utilizing electric power supplied from the electric power source, and a power control unit, being connected to the power-supply unit and a gate electrode of the representative lamp, for applying to a gate electrode of the representative lamp a representative gate voltage having a potential corresponding to an output voltage of the power-supply unit, the power control unit controlling the output voltage of the power-supply unit such that the representative gate voltage becomes suitable to the representative lamp;

wherein the power control unit is also connected to a gate electrode of the other lamp, for applying to a gate electrode of the other lamp a gate voltage which is generated by dividing the output voltage of the power-supply unit, the power control unit controlling a dividing ratio of the output voltage such that electrical power used for driving the other lamp becomes the same as electrical power used for driving the representative lamp.

2. The apparatus for driving a plurality of field emission lamps according to claim 1, wherein the power control unit controls the output voltage of the power-supply unit based on a cathode current and an anode voltage of the representative lamp; and controls the dividing ratio of the output voltage based on a cathode current and an anode voltage of the other lamp.

3. An apparatus for driving a plurality of field emission lamps, the apparatus comprising:

a power-supply unit, configured to connect to an electric power source, for generating stable direct-current power by utilizing electric power supplied from the electric power source, a voltage control unit, being connected to the power-supply unit, for controlling an output voltage of the power-supply unit; and a power control unit, being connected to the power-supply unit and a gate electrode of each of the field emission lamps, the power control unit generating a gate voltage for each of the field emission lamps by dividing the output voltage of the power-supply unit for each of the field emission lamps, and applying the generated gate voltage to the gate electrode of each of the field emission lamps, the power control unit controlling a dividing ratio of the output voltage for each of the gate voltages so that electrical power used for driving each of the field emission lamps become even, wherein the voltage control unit controls the output voltage of the power-supply unit so that each gate voltage is suitable to the respective field emission lamp.

4. The apparatus for driving a plurality of field emission lamps according to claim 3, wherein the voltage control unit controls the output voltage of the power-supply unit based on a cathode current and an anode voltage of each of the field emission lamps; and the power control unit controls the dividing ratio of the output voltage based on the cathode current and the anode voltage of each of the field emission lamps.

* * * * *